United States Patent [19]

Eskeli

[11] 3,933,008

[45] Jan. 20, 1976

[54] MULTISTAGE HEAT EXCHANGER

[76] Inventor: Michael Eskeli, 7994-41 Locke Lee, Houston, Tex. 77042

[22] Filed: Jan. 2, 1974

[21] Appl. No.: 429,496

[52] U.S. Cl. ..... 62/401; 165/88; 165/140; 415/1

[51] Int. Cl.[2] ..... F25B 3/00

[58] Field of Search ..... 165/86, 88, 140; 62/86, 62/87, 401, 402, 499; 415/1

[56] References Cited

UNITED STATES PATENTS

| | | | |
|---|---|---|---|
| 2,451,873 | 10/1948 | Roebuck | 165/88 |
| 2,522,781 | 9/1950 | Exner | 62/499 |
| 2,529,765 | 11/1950 | Exner | 62/499 |

FOREIGN PATENTS OR APPLICATIONS

| | | | |
|---|---|---|---|
| 633,985 | 6/1937 | Germany | 165/86 |

*Primary Examiner*—Albert W. Davis, Jr.
*Assistant Examiner*—Sheldon Richter

[57] ABSTRACT

A method and apparatus for transferring heat from a source at a lower temperature to a fluid at a higher temperature by employing a rotating centrifuge and a compressor to compress a gaseous first fluid with accompanying temperature increase and then transferring heat from said first fluid to a second fluid being in heat exchange relationship with said first fluid within said centrifuge. The first fluid is then allowed to expand within the rotor and heat is added during and after expansion from a third fluid being in heat exchange relationship with said first fluid. The first fluid is normally a gas, the second fluid may be a gas or a liquid, and the third fluid may be a gas or a liquid. Typical first fluid may be carbon dioxide, second fluid be water, and third fluid be water.

2 Claims, 4 Drawing Figures

MULTISTAGE HEAT EXCHANGER

CROSS REFERENCES TO RELATED APPLICATIONS

This application uses principles similar to those used in "Rotary Heat Exchanger" filed 8/31/73, Ser. No. 393,571, and "Heating and Cooling Wheel", filed 1/11/72, Ser. No. 216,938.

This invention relates generally to devices for transferring heat from a fluid at a lower temperature to another fluid at a higher temperature by employing a compressible fluid which is compressed within a continuous flow centrifuge to an elevated pressure with accompanying temperature increase, and this higher temperature is then used to effect heat transfer to a second fluid which is at a higher temperature than said lower temperature fluid, and providing means within said centrifuge to propel said gaseous compressible fluid through said centrifuge.

There have been several devices that have provided means for transferring heat from a lower temperature fluid to a higher temperature fluid. These devices have been inefficient due to the need to employ an external compressor to provide a pressure differential to transport the gaseous compressible first fluid through said centrifuge rotor; also, they have been incapable of producing the high temperatures needed to produce high pressure water steam due to inherent stress limitations imposed by materials of construction for the rotor.

It is an object of this invention to provide a means for producing high temperature fluids while using low temperature heat sources wherein the said first fluid is first compressed in a compression stage prior to passage to heat exchanger stage, and then expanding said first fluid in more than a single stage with addition of heat to said fluid during and after said expansion. The purpose of having multiple compression and expansion stages is to reduce the rotational speed of the rotor so that standard and readily available materials may be used for rotor construction, and also to extend the life of bearings and seals.

Figure 1:
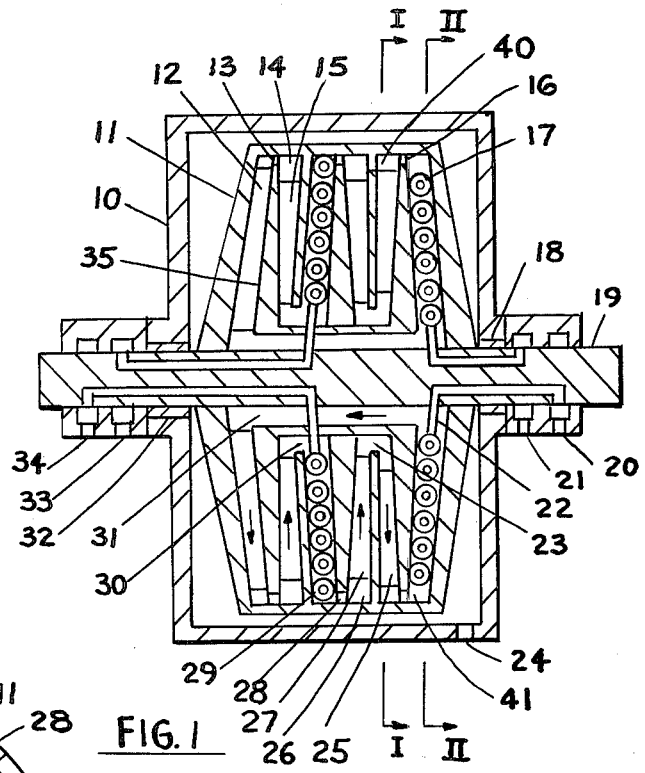
FIG. 1 is a cross section of the heat exchanger.

Referring to FIG. 1, therein is shown a cross section of the multi-stage rotary heat exchanger. 10 is casing, 11 is rotor, 12 is compressor stage vane, 13 are first nozzles, 14 is first fluid space, 15 are second vanes, 16 are third nozzles, 17 is heat addition heat exchanger, 18 is bearing and seal, 19 is rotor shaft, 20 and 21 are third fluid inlet and outlet, 22 is third fluid conduit, 23 is first fluid passage opening, 24 is casing vent into which a vacuum source may be attached, 25 are fourth vanes, 26 is second fluid space, 41 is third fluid space, 40 is a fluid space, 27 are third vanes, 28 are second first fluid nozzles, 29 is heat removal heat exchanger, 30 is first fluid passage, 31 is first fluid return passage, 32 is rotor shaft bearing and seal, 33 and 34 are second fluid entry and exit, 35 is a rotor interior dividing wall. Sections I and II are further illustrated in FIG. 3.

Figure 2:
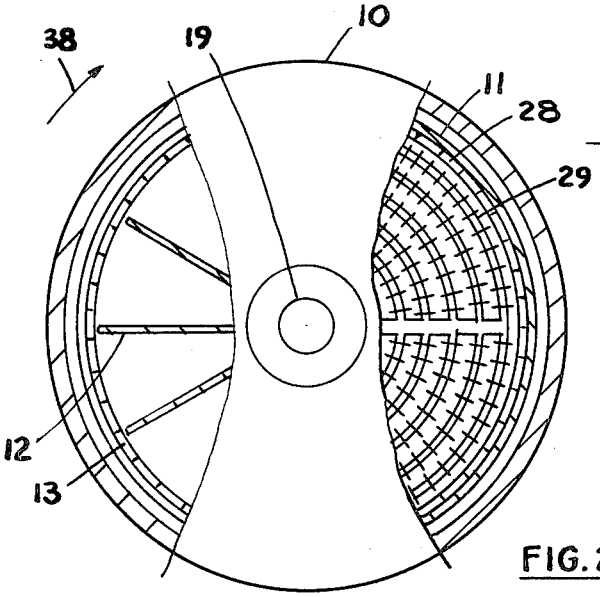
FIG. 2 is an end view of the unit shown in FIG. 1.

In FIG. 2, an end view of the unit is shown with portions removed to show rotor interior details. 10 is casing, 11 is rotor, 28 are third nozzles, 29 is heat removal heat exchanger, 13 are first nozzles, 12 are first vanes, 38 indicates direction of rotation, and 19 is shaft.

Figure 3:
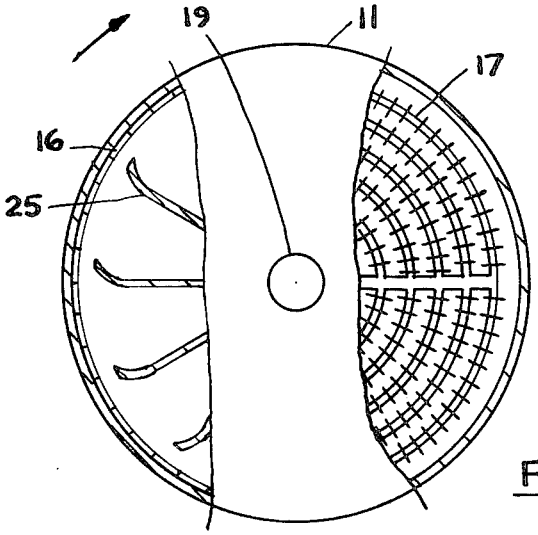
FIG. 3 is an end view of the rotor, showing some interior details.

In FIG. 3, and end view of the rotor is shown with additional interior details. 11 is rotor, 17 is heat addition heat exchanger, 25 are fourth vanes, 16 are third nozzles and 19 is rotor shaft.

Figure 4:
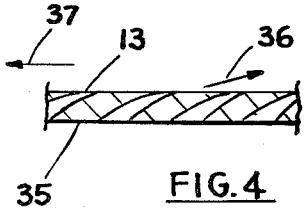
FIG. 4 is a section of rotor internal nozzles.

In FIG. 4, a detail of rotor nozzles is shown. 37 indicates direction of rotation when the nozzles are used in compressing section such as nozzles 13 and 28 in FIG. 1, and 36 indicates fluid leaving said nozzles. 35 is rotor divider wall, and 13 is nozzle. The third nozzles 16 are similar but oriented in opposite direction so that the first fluid leaves said nozzles in forward direction that is in the direction of rotation.

In operation, first fluid is first compressed in rotor outward extending passages defined by first vanes 12, and then passed via first nozzles 13 in backward direction that is away from direction of rotation so that said first fluid will have an absolute tangential velocity that is less than said rotor tangential velocity in same area. After leaving said first nozzles 13, first fluid is decelerated further in second vanes 15, and then passes via passage 30 near rotor center to be further compressed by passages formed by heat exchanger 29 fins which act as vanes, and at the same time heat is removed from said first fluid in a predetermined amount into a second fluid being circulated within said heat exchanger 29. After passing through the passage of heat exchanger 29, said first fluid is passed through second nozzles 28 that are oriented to discharge said first fluid in a backward direction and then passing to inward passages formed by vanes 27 and then passing through passage 23 near rotor center, after this said first fluid is accelerated in outward passages formed by vanes 25 and then said first fluid is decelerated in inward rotor passages formed by heat addition heat exchanger 17 fins; after this said first fluid is returned to be again compressed via passage 31 thus completing the work cycle for said first fluid. Said second fluid is supplied from external sources and passed through passages within rotor shaft to said heat exchanger 29 and then said second fluid is returned via said rotor shaft to exit. The said third fluid is also circulated via said rotor shaft to the heat eddition heat exchanger 17 and then returned via said rotor shaft to exit. The temperature of leaving second fluid is greater than the temperature of entering second fluid. The temperature of said third fluid entering is greater than the temperature of leaving third fluid.

The heat exchanger of this invention uses two stages of compression and two stages of expansion; additional compression and expansion stages may be used if desired to even further reduce the rotor rotational speed and to increase leaving second fluid temperature.

For some fluids, being used as said first fluid, nozzles 28 may be omitted, and plain openings substituted. Alternately, the second nozzles 28 may be arranged to discharge said first fluid forward so that the tangential velocity of leaving first fluid is greater than the tangential velocity of said rotor in the area. Also, the location of inner ends and outer ends of said first vanes 12, said second vanes 15, said third vanes 27 and said fourth vanes 25 may be as desired to obtain required pressure conditions within the rotor so that said first fluid is transported through said rotor passages and pressurized to the desired pressure, with a minimum work input to said rotor shaft from external sources. Further, it should be noted that heat exchangers 17 and 29 may have lesser amount of finned coils so that part of the respective first fluid passage is left open; in these instances, vanes are normally added within said first fluid passages to assure that said first fluid will rotate with said rotor. Also, the heat exchanger 29 may be extented into passages defined by vanes 12, if desired by design conditions for the first fluid being used. Similarly, heat exchanger 17 may be extented to passages defined by vanes 27 and 25 if desired by design conditions. Further, said heat exchanger 17 may be also extented to first fluid passage 31 if desired thus adding to heat exchanger area.

The first fluid used for the heat exchanger of this invention should be a gaseous and compressible fluid. Gases such as carbon dioxide, nitrogen or air may be used, and many of the halogenated hydrocarbons may also be used. Normally, the gas being used should not condense while being within the rotor, since condensation will block the first fluid passages. The second fluid may be a liquid or a gas; usually said second fluid is a liquid. The third fluid also may be either a liquid or a gas.

The heat exchanger coils within the rotor are shown having been made of finned tubing; other types of heat exchangers may be used, including types where said second fluid and said third fluid passages are built to rotor walls, or where metal heat conducting parts are employed to transfer heat from one fluid to another.

First fluid spaces 14, 26 and 41 are provided at discharge side of nozzles to provide a space for the first fluid to be discharged into.

Various governors and controls may be used with the heat exchanger of this invention. They do not form a part of this invention and are not further described.

Vanes 12, 15, 27 and 25 may be curved in conventional manner if desired. Similarly, the fins of the heat exchangers may be slanted if desired; for heat exchanger 29 they may be slanted backward if desired and for heat exchanger 17 slanted forward.

It should be noted that the first fluid is compressed within passageways defined by vanes 12, and also accelerated, and then the first fluid is decelerated in nozzles 13 and further decelerated in vanes 15. After passing to opening 30, the first fluid will be at a pressure that is greater than the pressure in passage 31, while the rotational speed of the first fluid has been reduced to a minor value existing in the area. The first fluid is then again accelerated in the second outward extending passageways wherein heat exchanger 29 is located, with a pressure increase. The first fluid is then passed through openings 28, which may be nozzles, or plain holes, depending on the design. Similarly, openings 16 may be nozzles or plain holes, depending on the design; it should be noted that if vanes 25 are curved as shown in FIG. 3, and with sufficient curvature forward, the openings 16 may be plain holes. If vanes 25 are straight and radial, then openings 16 should be nozzles. However, by combining curved vanes, adjusting vane lengths, using nozzles or using plain openings, suitable pressure conditions may be obtained to assure that the first fluid will flow in the desired direction, with least amount of work required to rotate said rotor from external sources. Functionally, it is desired to obtain a high pressure and a high temperature for the said first fluid in the area where said heat exchanger means 29 is located, so that the second fluid leaving said heat exchanger means 29 is at a high temperature, and then reduce the pressure of said first fluid with most work recovery, so that said work input to said rotor is at a minimum.

The main application of the multistage heat exchanger of this invention is in steam generation; normally, the second fluid is not vaporized within the rotor but is maintained under a sufficient pressure to prevent such vaporization. Other applications include other uses where high temperature heat source is required, or where the third fluid temperature is low thus requiring a high temperature differential between said second fluid and said third fluid.

I claim:

1. A multistage heat exchanger comprising:

a. a means for supporting a shaft in bearings for rotation;

b. a shaft;

c. a rotor mounted on said shaft so as to rotate in unison therewith, said rotor having first radially outward extending passages connecting at their outward ends with first inward extending passages, said first inward extending passages connecting at their inward ends with second outward extending passages, said second outward extending passages connecting at their outward ends with second inward extending passages, said second inward extending passages connecting at their inward ends with third outward extending passages, said third outward extending passages connecting at their outward ends with third inward extending passages, said third inward extending passages connecting at their inward ends with the inward ends of said first outward extending passages for passing a first fluid, said second outward extending passage having a first heat exchanger means for removing heat from said first fluid during and after compression of said first fluid by said rotor, said third inward extending passages having second heat exchanger means for adding heat into said first fluid after said first fluid has been cooled by expansion within said rotor, said first heat exchanger means being supplied with a second fluid and circulated in heat exchange relationship with said first fluid, said second heat exchanger means being supplied with a third fluid and circulated in heat exchange relationship with said first fluid, said second fluid and said third fluid being passed into their respective heat exchangers via fluid passages within said rotor.

2. The multistage heat exchanger of claim 1 wherein said first outward extending passages are provided with nozzles at their said outward ends for passing said first fluid into said first inward extending passages.

* * * * *